United States Patent [19]

Houston

[11] Patent Number: 4,895,014

[45] Date of Patent: Jan. 23, 1990

[54] FAILSAFE TOOL CLAMPING SYSTEM FOR PRESS BRAKE

[76] Inventor: David L. Houston, 7444 Brookside Dr., Hanover Park, Ill. 60103

[21] Appl. No.: 201,541

[22] Filed: Jun. 2, 1988

Related U.S. Application Data

[63] Continuation-in-part of Ser. No. 901,438, Aug. 28, 1986, Pat. No. 4,787,237.

[51] Int. Cl.[4] ..... B21D 37/04

[52] U.S. Cl. ..... 72/481; 72/462; 72/389

[58] Field of Search ..... 72/389, 462, 465, 481; 403/5, 15, 16

[56] References Cited

U.S. PATENT DOCUMENTS

| | | | |
|---|---|---|---|
| 4,315,425 | 2/1982 | Zbornik et al. | 72/389 |
| 4,506,538 | 3/1985 | Jones, Jr. | 72/481 |
| 4,612,796 | 9/1986 | Smyth, Jr. | 72/389 |

FOREIGN PATENT DOCUMENTS

| | | | |
|---|---|---|---|
| 0237800 | 9/1987 | European Pat. Off. | 72/481 |
| 1232804 | 1/1967 | Fed. Rep. of Germany | 72/462 |
| 3203681 | 8/1983 | Fed. Rep. of Germany | 72/462 |
| 0199523 | 12/1982 | Japan | 72/462 |
| 0180067 | 2/1966 | U.S.S.R. | 72/481 |

*Primary Examiner*—David Jones

*Attorney, Agent, or Firm*—Hill, Van Santen, Steadman & Simpson

[57] ABSTRACT

A tool support structure for a press brake has a plurality of independently movable clamps, each of which is independently spring biased for linear movement into a clamped position wherein the clamps secure a tool in the structure. The clamps are about one inch long to ensure full, continuous clamping contact with the tool. Release of the clamping action is accomplished by either a hydraulic system or a wedge system which, when activated, overcomes the bias force and moves the clamping members to the release position wherein the tool may be removed from the structure.

22 Claims, 8 Drawing Sheets

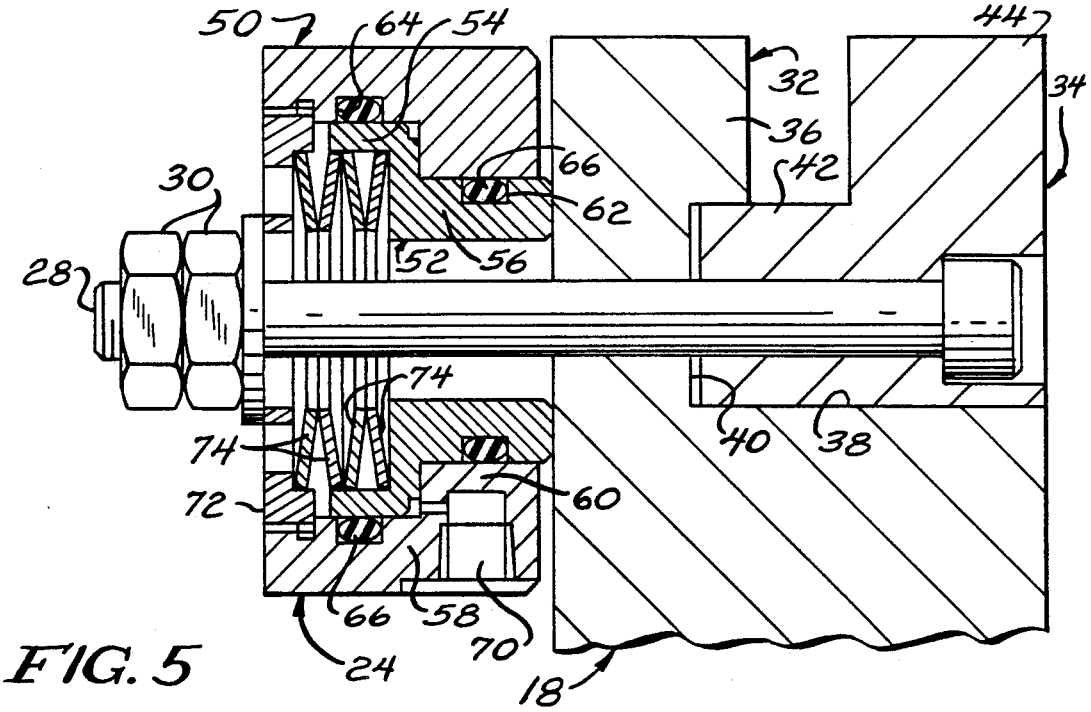
FIG. 5
FIG. 6
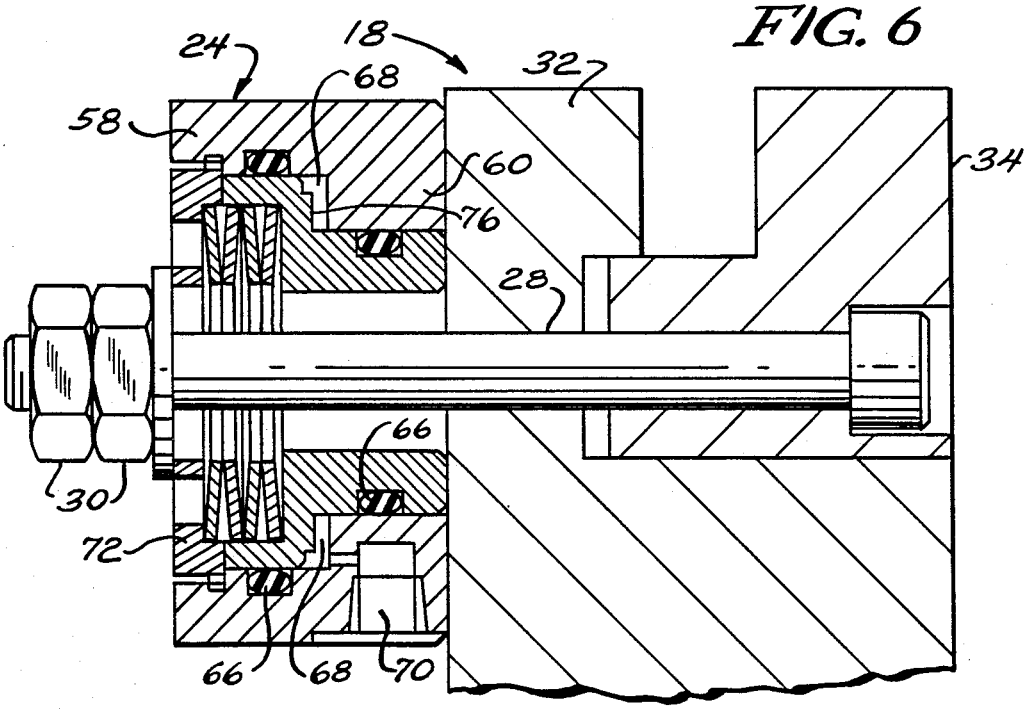

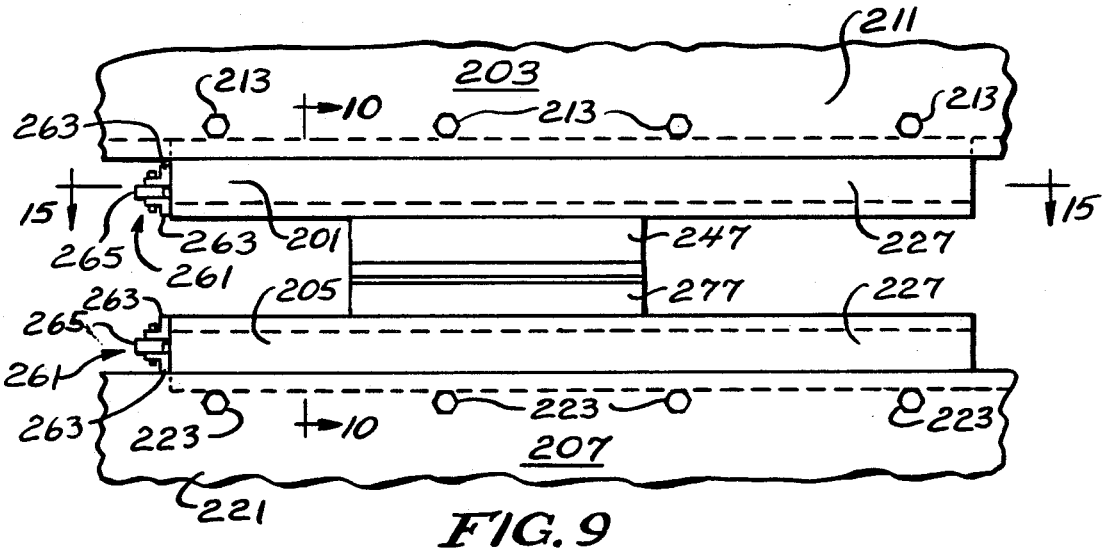
FIG. 9
FIG. 10
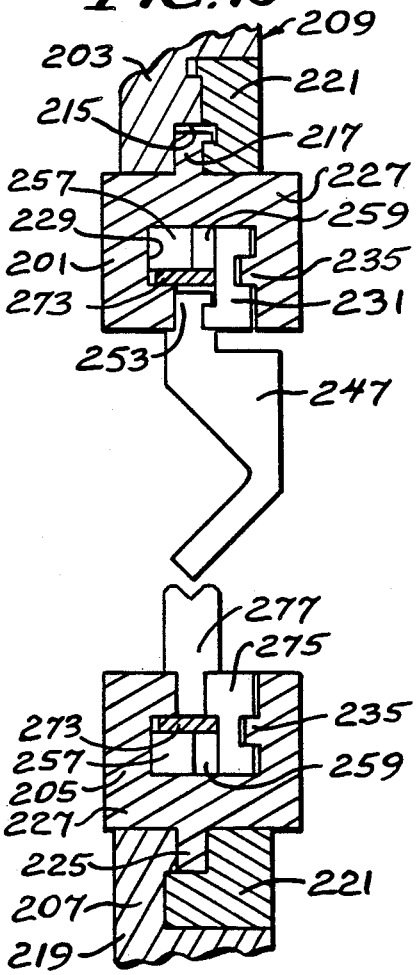
FIG. 11
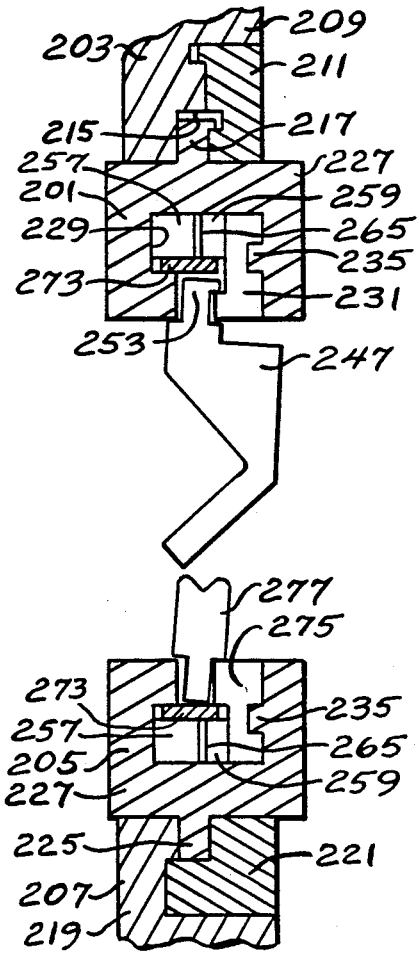

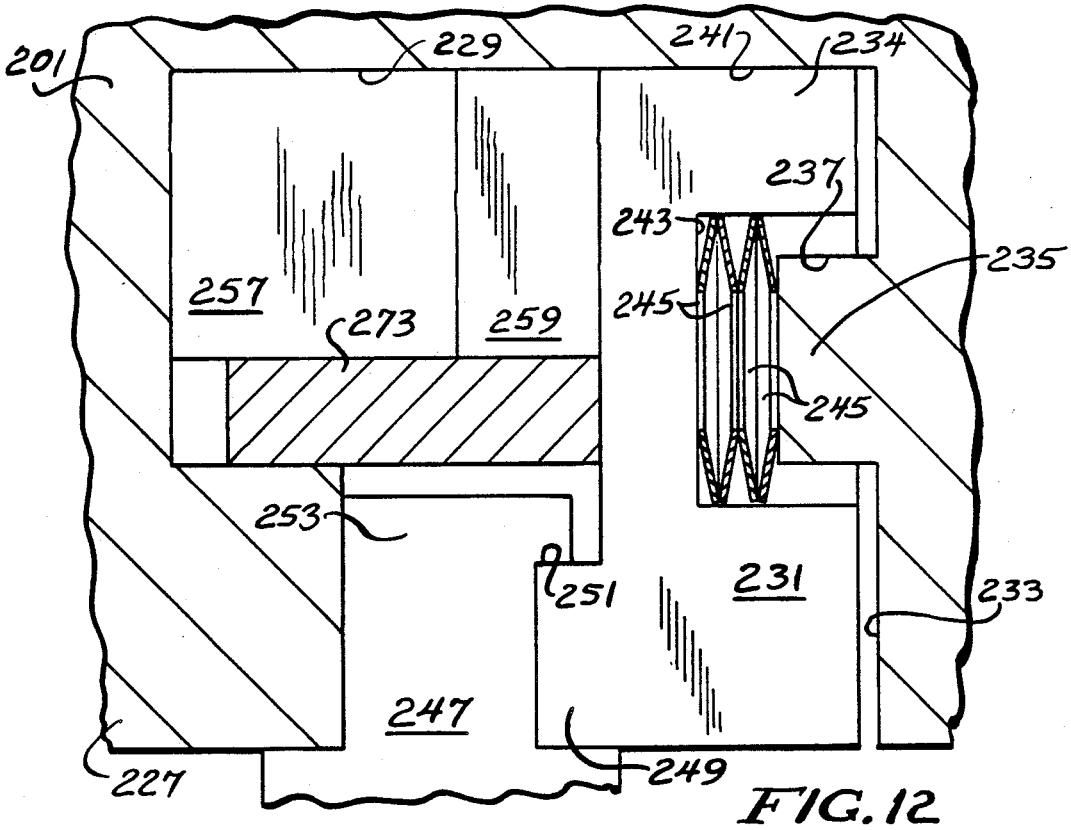
FIG. 12
FIG. 13
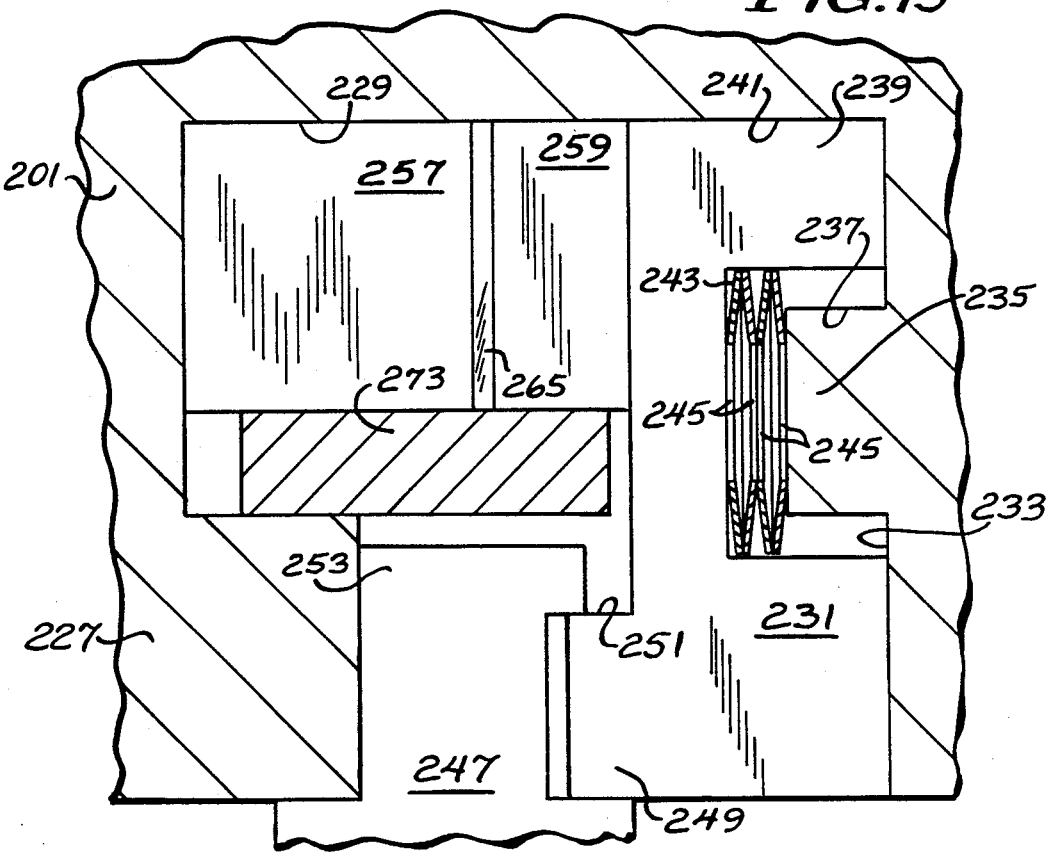

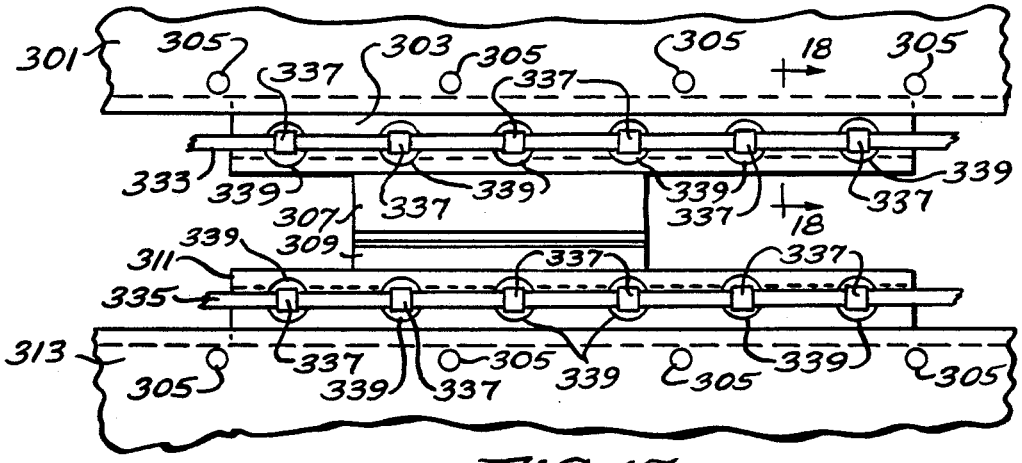
FIG. 17
FIG. 18
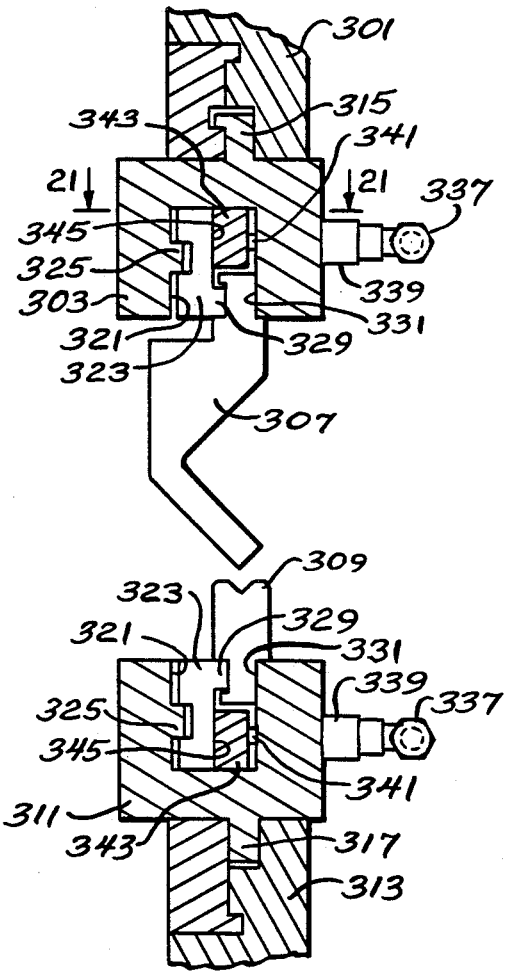
FIG. 19
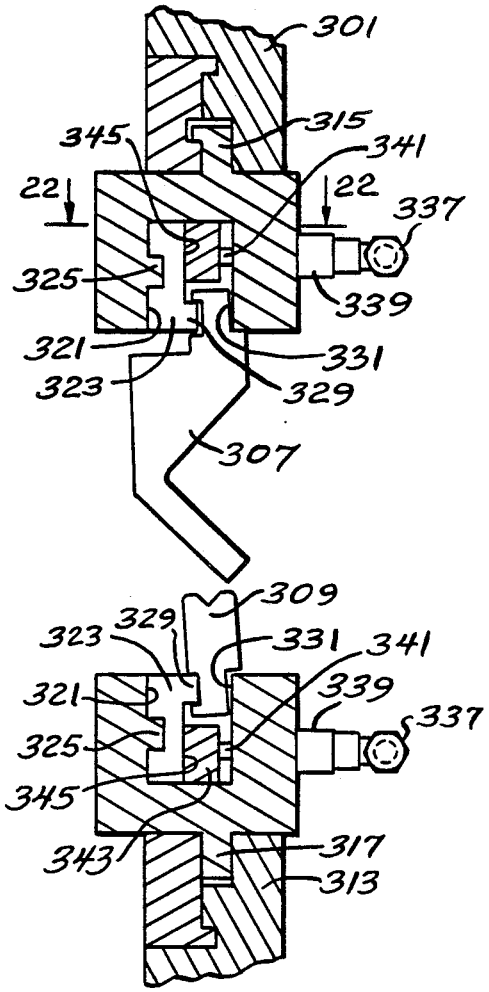

FAILSAFE TOOL CLAMPING SYSTEM FOR PRESS BRAKE

RELATED APPLICATIONS

This application is a continuation-in-part of the patent application having Ser. No. 901,438 filed Aug. 28, 1986, now U.S. Pat. No. 4,787,237, and entitled FAILSAFE TOOL CLAMPING SYSTEM FOR PRESS BRAKE.

FIELD OF THE INVENTION

The present invention relates to a press brake for bending and otherwise forming sheet material. More specifically, the invention relates to a pressure/spring actuated clamping system to secure a punch and die set to a press brake.

DESCRIPTION OF THE PRIOR ART

Press brakes are industrial devices used to bend or otherwise form sheeted material such as sheet metal. A press brake includes a bed and a ram, the ram being disposed above, and vertically movable over, the bed. Both the ram and the bed extend across the entire front portion of the press brake. Clamps for securing a punch and a die (i.e. the tool set) are provided respectively, on both the ram and the bed. The punch extends downwardly from the ram and the die extends upwardly from the bed to matingly receive the punch. Bending or forming of the sheet material or work piece is accomplished by forcefully lowering the ram and punch thereby sandwiching the work piece between the punch and die. Some press brakes accomplish a similar result with a stationary upper member holding the punch and a movable lower member holding the die. The lower member and the die are moved upwardly, and the work piece is sandwiched between the punch and the die.

In a typical press brake operation, sheeted material is placed between the punch and die and aligned according to the plans or requirements of the particular job. With the material properly oriented, the ram is moved vertically downward thereby moving the punch toward the die. As the punch is lowered, it contacts the sheeted material and, with adequate force exerted by the ram, the sheeted material is bent or otherwise formed by the co-acting surfaces of the punch and die. The bends in the sheeted material are unique to the particular tool set combination employed for each job.

Conventionally, the tool set is clamped on the ram and bed by tightening a series of bolts or set screws spaced at approximately twelve inch intervals. A long recognized difficulty with conventional press brakes is the lengthy set-up time required when one tool set is substituted for another. Large press brakes have rams and beds which often exceed 10 to 20 feet in length, consequently, more than two dozen bolts or screws must be loosened and retightened each time the tool set is changed. The problem of set-up time is particularly acute where the tool set must be replaced frequently, that is, where numerous jobs of small lot size are contemplated. Use of large tools, with their correspondingly high number of securement bolts, further aggravate the set-up time problem.

Another problem presented by conventional press brakes is that the tool is clamped between two members of substantial length. When a tool with slight variation in thickness is used, and particularly if a tool is used having several discrete segments, the clamping of the tool may be incomplete, and portions or segments of the tool may be loose.

In order to solve these problems, a pressure/spring actuated fail safe clamping system is utilized to eliminate the need for loosening and retightening numerous bolts each time the tool set is changed. The system includes separate bed and ram clamp assemblies; each assembly comprising a fixed and a slidable clamping member. The bed clamp assembly, which is of an interlocking, L-shaped configuration to alleviate misalignment of the tool die upon clamping, is positioned on the bed of a conventional press brake.

It should be noted that pressure actuated clamp mechanisms have been commercially available for some time. Such mechanisms, however, exhibit certain shortcomings for which the present invention was developed to overcome. Specifically, conventional systems require positive pressure to keep the clamp jaws securely closed. In systems of this type, a sudden loss of pressure will cause the clamp jaws to open, potentially releasing the object held therebetween. Such a pressure loss can occur by the rupture of accidental severing of a hydraulic line or upon the interruption of electric service at the site. As many punches do not incorporate additional safety features to assure retention of the punch upon loss of clamping action by the ram clamp, the loss of pressure could result in the release of the punch weighing hundreds of pounds.

The present invention avoids the loss of pressure problem of conventional systems. Specifically, the present invention operates in a failsafe manner by requiring positive pressure to open the clamp jaws. Unlike conventional systems, a sudden loss of pressure will close the clamp jaws thereby avoiding the potentially dangerous situation existing in prior art systems.

Further, in one embodiment of the present invention a plurality of relatively short clamping members, about one inch in length, replace the elongate clamping member of conventional brake presses. This arrangement greatly enhances the clamping where multiple or mixed tools must be used.

Therefore, it is an object of this invention to provide a simple, yet effective, solution to the problems raised by conventional press brake clamps.

It is another object of this invention to reduce the time required to change a tool set on a press brake by eliminating the need to loosen and retighten a series of bolts or set screws every time a tool set is changed.

It is still another object of this invention to provide a pressure/spring actuated clamping system for use on a press brake.

It is also an object of this invention to provide a tool clamping structure having a plurality of clamping elements to improve clamping of the tool set on the press brake.

These and other objects and advantages of this invention will become apparent from the remaining portions of this specification.

SUMMARY OF THE INVENTION

The clamping system disclosed herein includes a clamp assembly on both the ram and the bed and a set of one or more pressure actuated control units (actuator means) for controlling both clamp assemblies. Each clamp assembly comprises a fixed member and a sliding member which coact, under the control of the actuators, to provide a clamping action. The bed clamp members interlock to preclude rotary movement of the die upon the clamping retention thereof. Specifically, the sliding clamp member of the bed clamp assembly is L-shaped with one leg of said L-shaped member being received within a recess provided in the fixed bed member. With the clamp closed, the leg of the L-shaped member fits snugly into the recess thereby preventing the sliding member from rotating or rocking out of position while supporting a die tool.

Each actuator is retained in position next to the fixed clamp member of the ram or bed. Retention of said actuator is achieved with a clamp bolt. Pressure tubing is used to link the actuators for simultaneous application of pressure to all actuators. Each actuator comprises a cylinder containing a piston and a compression spring. The clamp bolt extends through the fixed and sliding clamp members, then, axially through the actuator where the actuator is secured in position adjacent to the fixed clamp member by a pair of hex nuts.

The actuator springs serve to provide the necessary clamping force by urging respective actuator pistons against the fixed clamp member which, in turn, force the actuator cylinders and clamp bolts in the opposite direction. This axial movement of the clamping bolt biases the sliding clamp member toward the fixed clamp member thereby engaging the tool die without having to apply pressure to the system. The clamp assembly can be opened by applying sufficient hydraulic or pneumatic pressure to overcome the force of the actuator springs.

In another embodiment of the present invention, the slidable clamping member, which may typically be in excess of 10–20 feet in length for larger presses, is replaced by a segmented clamping arrangement employing a plurality of relatively short clamp members (typically one inch), each having its own independent spring biasing means, to effect tool clamping. Segmented clamping has been found to provide greatly improved tool clamping over a mixed range of tool sizes.

The segmented clamp system may be released by either mechanical or hydraulic means. In the preferred mechanical arrangement, pairs of coacting wedge members are employed to create the necessary clamp release forces. More particularly, one member of each pair of wedges is urged longitudinally, through the application of a mechanical force, thereby, in turn, moving a second mating wedge laterally into engagement with the clamp members.

Hydraulic release is achieved through the use of plural hydraulic cylinders or actuators each of which acts upon an interface or release member. The release member serves to distribute the hydraulic actuator forces substantially uniformly to all of the segmented release members.

BRIEF DESCRIPTION OF THE DRAWINGS

FIG. 3 shows the clamp closed while FIG. 4 shows the clamp open;

FIGS. 5 and 6 are cross-sectional views of the bed clamp assembly and actuator taken substantially along line 5—5 of FIG. 2. FIG. 5 is shown in the clamped position while FIG. 6 is shown in the open or released position;

FIG. 9 is a fragmentary elevational view of a further alternate embodiment of the clamp assembly;

FIG. 10 is an enlarged cross-sectional view taken along line 10—10 of FIG. 9, and shows the clamping assemblies in the clamped condition;

FIG. 11 is a view as in FIG. 10, but shows the clamping assemblies in the release condition;

FIG. 12 is an enlarged detail view of FIG. 10, showing the ram clamping assembly in the clamped condition;

FIG. 13 is a view as in FIG. 12, but shows the ram clamping assembly in the release condition;

FIG. 17 is a elevation of an alternate embodiment of clamp assembly similar to that of FIGS. 9 to 16, but making use of a hydraulic release system;

FIG. 18 is a sectional view taken along line 18—18 of FIG. 17 and showing the tool support structure clamped;

FIG. 19 is a view as in FIG. 18, but showing the tool support structure in the release condition.

DETAILED DESCRIPTION OF THE INVENTION

Figure 1:
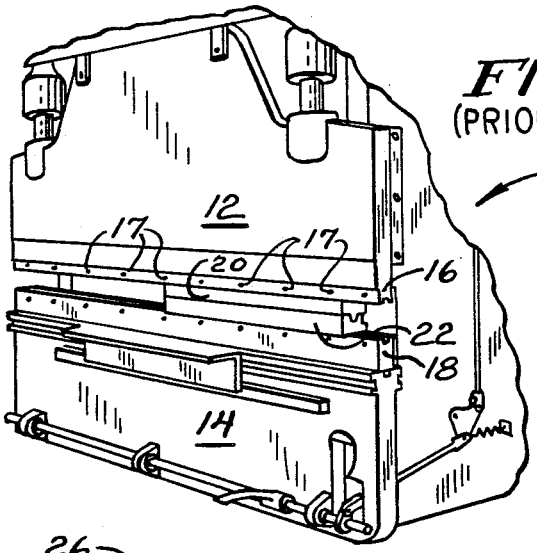
FIG. 1 (PRIOR ART)
FIG. 1 is a perspective view of a conventional press brake fitted with the hydraulic failsafe clamping system of the present invention.

Referring to FIG. 1, a typical press brake 10 is shown including a ram member 12 and the bed member 14. Both the ram 12 and bed 14 extend across the entire front portion of the press brake 10. The ram 12 is vertically movable over the bed 14 and includes a ram clamp assembly 16 which, in a conventional press brake, incorporates a plurality of independently manipulable bolts at 17 for rigidly securing the tool punch in position below the ram 12. As set forth in more detail below, hydraulic failsafe actuators are placed along the ram corresponding to each of these ram securement bolts. A bed clamp assembly 18 is positioned on the press brake bed to rigidly clamp a tool die.

A tool set comprising a punch 20 and a die 22 is clamped by the ram and bed clamp assemblies 16 and 18, respectively. In a typical press brake operation, sheeted material, such as sheet metal, is placed between the punch 20 and die 22 and oriented therebetween according to the plans or requirements of the particular job. With the sheet material or work piece thusly positioned, the ram member 12 is lowered until the work piece is engaged by both punch and die with sufficient force to bend or otherwise form the work piece according to the shape defined by the mating tool surfaces. The configuration of the ends in the sheeted material is unique to the particular tool set combination employed for each job.

Figure 2:
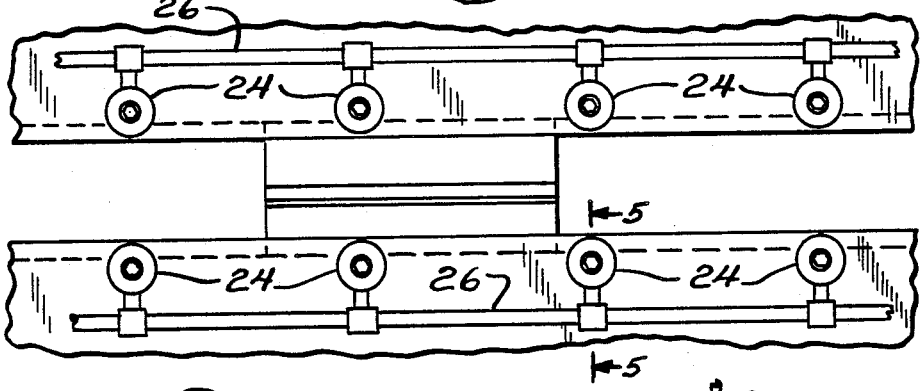
FIG. 2 is a fragmentary rear elevational view of the press brake of FIG. 1 showing the alignment of actuators along the fixed members of both the ram and bed clamping assemblies.

Referring now to FIG. 2, illustration is made of a series of pressure actuated control units or actuators 24. Actuators 24 are attached to both the ram and bed clamp assemblies 16, 18. As set forth in more detail below, the actuators are positioned along, and secured to, the ram clamp assembly by bolts extending from the actuators through holes in the ram clamp assembly. Preferably, the actuators will be mounted along the ram utilizing existing holes initially intended to permit manual clamping of the tool punch. Actuators are similarly secured to the bed clamp assembly although it will be noted that conventional press brakes do not utilize such assemblies.

Actuators 24 are interconnected by pressure tubing 26 so that hydraulic or pneumatic pressure may be communicated simultaneously to all of the actuators 24 or, alternatively, to actuator groups corresponding to the ram and bed clamp assemblies, respectively. In the depicted embodiment, the actuators are positioned along the back of the clamp assemblies in order to protect both the actuators 24 and the interconnecting tubing 26 from accidental damage.

Referring now to FIGS. 5 and 6, an enlarged, cross-sectional view of the bed clamp assembly 18 and actuator 24 according to one preferred embodiment is shown. A clamp bolt 28, which extends through the actuator 24 and the bed clamp assembly 18, secures each actuator in position on the bed clamp assembly. More specifically, a pair of nuts 30 are provided on the end of each bolt 28 to retain the actuator and, as detailed below, to provide an adjustment mechanism by which the maximum axial length of the actuator and bed clamp assembly may be set.

Figure 3:
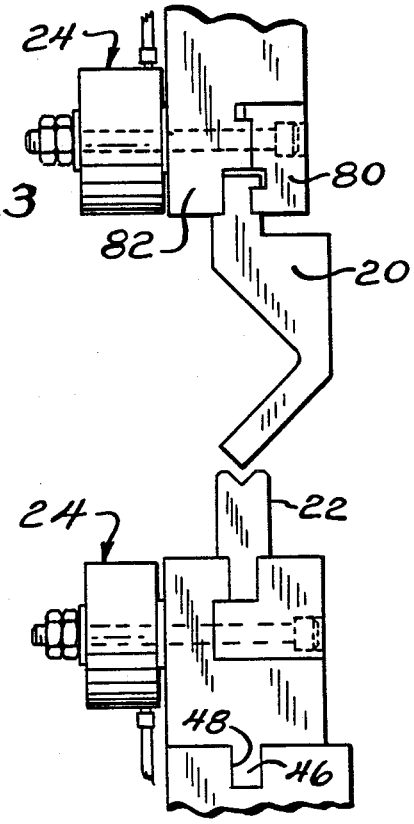
FIGS. 3 and 4 are left elevation views of the clamping system of the present invention.

The bed clamp assembly 18 is defined by a fixed bed member 32 and a sliding bed member 34. Importantly, clamp bolts 28 function not merely to secure respective actuators 24 in proper orientation adjacent the bed clamp assembly, but, to effect the relative movement of the fixed and sliding clamp members 32, 34 upon operation of the actuators as required to rigidly secure a tool die therein. As discussed below, actuators 24 force the leftward movement of bolts 28, relative to the fixed bed clamp member, which, in turn, cause the corresponding leftward travel of the sliding member 34 thereby clamping a tool die positioned on the bed clamp assembly as illustrated in FIG. 3.

Referring to FIG. 5, the fixed bed clamp member 32 defines a vertical jaw 36, adapted to cooperate with the sliding clamp member to grip tools therebetween, and a generally planar horizontal surface 38 on which the sliding clamp member 34 is positioned. A recess 40 is provided along the full inside length of fixed vertical jaw 36, immediately adjacent surface 38, for receipt of a lateral extension 42 of the sliding clamp member 34.

In this connection, the sliding clamp member 34 defines an L-shaped cross-section having a sliding vertical jaw 44 and an integral lateral extension 42. The fixed and sliding jaws 36 and 44, respectively, serve to rigidly clamp the tool die 22 therebetween as outlined in more detail below. The vertical height of recess 40 is slightly greater than the corresponding vertical dimension of lateral extension 42 (approximately 0.002–0.003 inch) thereby facilitating the lateral movement of the sliding clamp member while, importantly, precluding the rotational or lifting movement of that member otherwise found to occur upon tool engagement.

The bed clamp assembly is provided with a tongue 46 along the bottom of the fixed clamp member (FIG. 3) which is adapted to be seated within a complementary recess 48 commonly provided in press brake beds. The bed clamp assembly may be secured to the press brake bed using the conventional system of bolts or set screws.

As shown in FIGS. 5 and 6, each actuator 24 includes an outer casing or cylinder 50 and a piston 52 adapted for axial movement generally within the cylinder. In this connection, and as illustrated in FIG. 5, the piston extends outwardly of the cylinder to effect tool die clamping. Both piston and cylinder comprise two distinct regions charactered by their respective differing diameters. The piston regions 54 and 56, wide and narrow respectively, are adapted for axial movement within corresponding regions 58 and 60 of the cylinder. Annular recesses 62, 64 are provided in the narrow region of the piston and in the wide region of the cylinder. O-ring seals 66 are fitted into these recesses which seals, in turn, function to create a pressure-tight chamber 68 (FIG. 6) within the cylinder. A port 70, in pressure communications with chamber 68, is provided through the cylinder of each actuator whereby the chambers may be pressurized. As outlined above, pressure tubing 26 interconnects the various actuators 24 whereby the chambers of the actuators may be simultaneously pressurized.

An end cap 72 is positioned within the wide region of the cylinder, at the outer end thereof. This cap may be retained within cylinder 50 utilizing conventional screw thread means or, alternatively, a bayonet interlock may be used. One or more compression Belleville-type springs 74 (4 shown) are positioned within the cylinder between the piston and the end cap. As springs 74 are maintained under compression, a continuous biasing force, preferably in the order of about 600–700 lbs., is applied to the piston urging it to the right until, in the absence of sufficient hydraulic pressure in chamber 68, the wide region of the piston interferingly contacts the narrow cylinder region as shown in FIG. 5. In this orientation, the piston extends outwardly to the right of the cylinder thereby increasing the overall axial length of actuator 24.

Leftward movement of the piston within the cylinder requires the pressurization of chamber 68. Specifically, pressurized hydraulic fluid acting against the radial surface 76 of the piston generates a leftward axial force on the piston. As shown in FIG. 6, the piston is moved to the left and the tool die is released when hydraulic pressure sufficient to overcome spring 74 is applied. Commercial actuators may be employed with the present invention, for example, an Enerpac, Toyo Hydraulic Equipment Co., Ltd., model WRS-75 QBC clamp.

Figure 4:
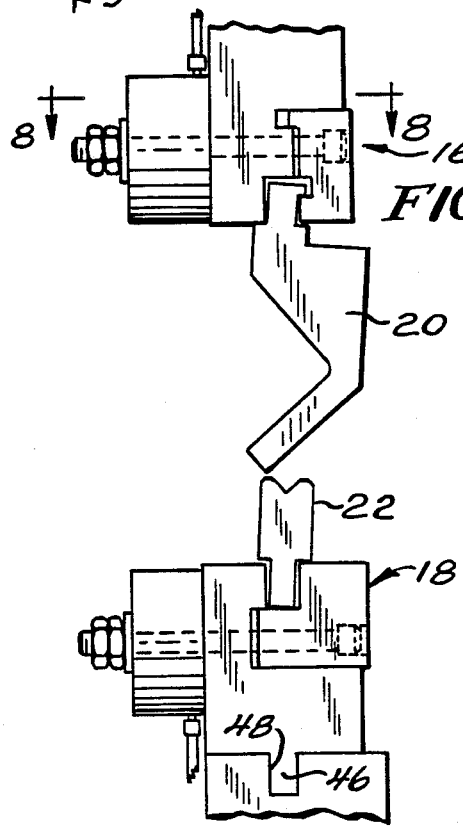

Operation of the present clamping system is best shown by reference to FIGS. 3–6 in which FIGS. 3 and 5 illustrate the assembly in the clamped state while FIGS. 4 and 6 show the assembly in the unclamped state. A clamping force is provided, as previously noted, by compression springs 74 which urge piston 52 against the surface of fixed bed clamp member 32 thereby forcing the actuator cylinder 50 and bolt 28 leftward with reference to the piston and, importantly, the fixed member 32 of the bed clamp assembly. This, in turn, forces the sliding clamp member 34 to correspondingly move leftward until the tool die 20 is engaged between the clamp members as shown in FIG. 3.

The die is rigidly held within the bed clamp assembly by reason of the plurality of actuators, spaced along the assembly at approximately 12 inch intervals. Each actuator applies its full spring force of 600–700 lbs. to the clamp assembly. Significantly, full tool clamping action is achieved by the internal actuator springs 74 without application of hydraulic pressure. Indeed, hydraulic pressure is required to release, rather than clamp, the tools and, therefore, it will be appreciated that the present arrangement provides for failsafe tool clamping; that is, maintains full tool clamping, in the face of an unexpected loss of hydraulic pressure.

Referring to FIGS. 4 and 6, the bed clamp assembly 18 is shown with members 32 and 34 in the open position. To open the clamp assembly, pressurized hydraulic fluid, generally in excess of 1000 psi, is applied simultaneously to the actuators 24 as set forth above. This pressure is sufficient to overcome the force exerted by compression springs 74 thereby causing pistons 52 to withdraw leftward within cylinders 50. This, in turn, releases the clamping force applied through bolt 28 to the sliding clamp member 34. The tool die 22 may be removed.

The above discussion has been specifically directed to the bed clamp assembly. It will be noted, however, that the ram of the press brake utilizes a clamping arrangement similar to that just discussed including sliding and fixed ram clamp members 80 and 82 (FIGS. 3 and 4), respectively, and identical actuators 24. Installation of the actuators on the ram 12 requires only the removal and replacement of each existing ram clamp bolt with an actuator 24 and longer clamp bolt 28. FIG. 3 shows both clamp assemblies, with hydraulic pressure removed, rigidly securing the respective tools while FIG. 4 shows both clamp assemblies, with hydraulic pressure applied, open thereby permitting the removal of the tools. A hydraulic (or pneumatic) pressure source is required, as outlined above, to effect release of tools by the clamp assemblies. Such pressure sources, however, are well known and available commercially and, therefore, will not be considered further herein.

Figure 7:
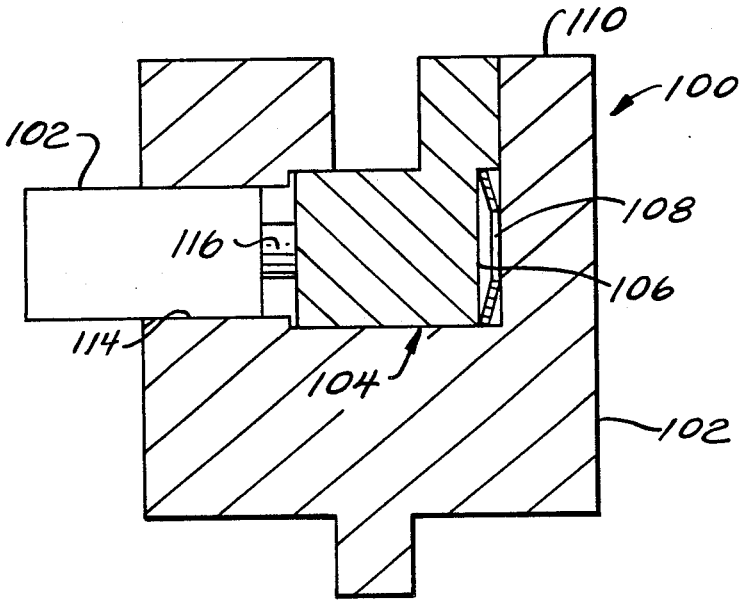
FIG. 7 is a cross-sectional view of an alternative embodiment of the bed clamp assembly of the present invention taken along line 5—5 of FIG. 2.
Figure 8:
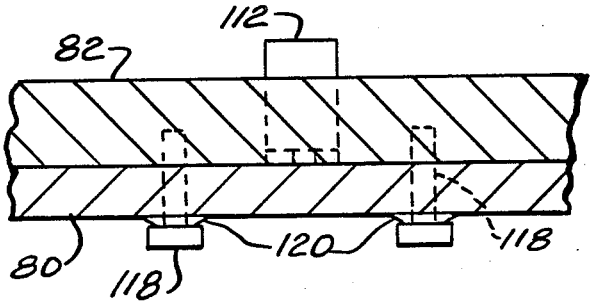
FIG. 8 is a cross-sectional view of an alternative embodiment of the ram clamp assembly taken along line 8—8 of FIG. 4.

FIGS. 7 and 8 illustrate another embodiment of the present invention in which the actuators 24 are replaced by separate clamping bias springs and hydraulic cylinders. FIG. 7 depicts the bed clamp assembly 100 according to this second embodiment including a U-shaped fixed bed clamp member 102 and an L-shaped sliding bed clamp member 104. Clamp member 104 is similar to the clamp member 34 considered above except that a plurality of spaced recesses 106 are provided along the length of clamp member 104 to receive the Belleville-type compression springs 108 therein.

The fixed clamp member 102 is also similar to the previously considered member 32 except that member 102 includes a tongue or back-stop 110 against which the compression springs 108 act thereby urging the sliding member 104 leftward into clamping engagement with the die.

A plurality of hydraulic push cylinders 112 are spaced along the fixed clamp member 102. Hydraulic cylinders 112 are of conventional design and include external threads to be received within the internally threaded holes 114 spaced along the fixed clamp member. Cylinders 112 are interconnected, as previously discussed, to a source of hydraulic pressure. Upon pressurization, a piston, with shaft 116 connected thereto, is urged to the right which, in turn, forces the corresponding sliding movement of clamp member 104 thereby releasing the die (not shown) therein.

FIG. 8 illustrates this second embodiment of the present invention as applied to the ram clamp assembly. Push cylinders 112 are threaded into existing holes spaced along the fixed ram clamp member 82. These cylinders, as explained with respect to the bed clamp assembly above, urge the sliding ram clamp member 80 outwardly upon pressurization of the cylinders 112 thereby releasing the punch.

The sliding ram clamp member 80 is retained adjacent the fixed clamp member by a plurality of spaced bolts 118 threadably received in the fixed clamp member. A Belleville-type compression spring 120 is positioned between each bolt 118 and the sliding clamp member. These springs, acting against the respective bolts, force the sliding clamp member into tight engagement with the fixed clamp member or punch therein.

It will be appreciated that the second embodiment of the present invention also provides for fail-safe operation in that hydraulic pressure is required to overcome the clamping action of the Belleville compression springs. If hydraulic pressure is lost or inadvertently removed, the punch and die set remain firmly clamped in operative position. It will be further appreciated that the second embodiment similarly positions the hydraulic cylinder and requisite hydraulic interconnection lines behind the ram and bed thereby minimizing the likelihood of damage thereto during normal press brake operation.

FIGS. 9 through 15 disclose another alternate embodiment of the clamping arrangement of the invention having a plurality of small, independently movable clamping members which, as noted more fully below, ensures, full clamping contact with a tool on either the ram or bed.

As best shown in FIGS. 9, 10 and 11, ram tool support structure 201 is secured in engagement with press brake ram 203, and bed tool support structure 205 is supported on press brake bed 207. The ram 203 includes a body part 209 and a clamp part 211 which are secured together by securement means or bolts 213. It will be understood that a variety of securement means may be used to secure the ram tool support structure 201 to the ram 203. Body part 209 and clamp part 211 define an L-shaped recess 215 therebetween configured to receive punch tools which generally have an upwardly extending L-shaped extension for securement to the ram 203. Upper tool support structure 201 has an upwardly extending L-shaped connection portion 217 which emulates the usual punch tool. This allows the clamping assembly to be applied to conventional press brakes without significant modification of the press brake, while providing the highly desirable function of quick tool replacement.

Similarly the bed 207 has a body part 219 and a clamp part 221 configured to clamp a die tool responsive to tightening of securement means or bolts 223. Lower tool support structure 205 has a downwardly extending portion 225 which emulates a die tool for connection to the bed 207.

The upper tool support structure 201 includes a body portion 227 integral with L-shaped connection portion 217. Body portion 227 has a downwardly disposed recess 229 which houses the clamping assembly.

Figure 14:
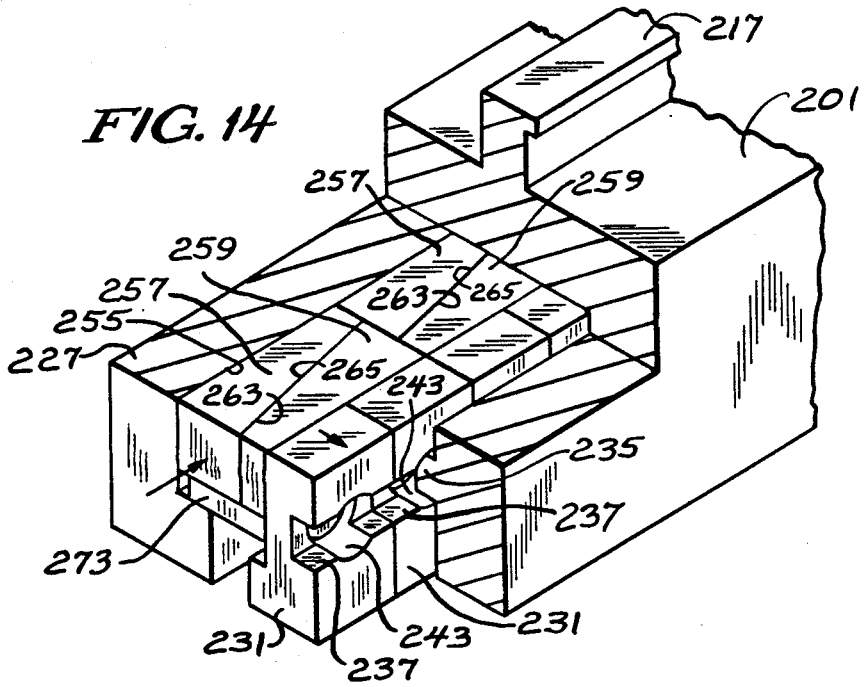
FIG. 14 is a partially cut-away perspective view of the ram clamping assembly.

As best shown in FIGS. 12, 13 and 14, a plurality of clamp members 231 are longitudinally positioned and supported in recess 229. Each clamp member 231 is supported for independent, substantially linear movement in a generally lateral direction, that is, transverse to both the longitudinal ram axis and the vertical tool/-die movement axis.

It has been discovered that the use of the present segmented clamp member, comprised of plural individual clamp members 231, provides superior tool clamping, particularly where multiple tools, or tools of varying lengths, or short tools, are required. Use of single (or multiple) long clamp members often results in inconsistent clamping pressure along the entire length of the ram which, in turn, may cause loose or improper retention of certain smaller tools, or regions of larger tools. Preferably each clamp member 231 will extend approximately one inch along the length of the tool support structure 201, although clamp member lengths from about ½ inch or less to about one foot or greater are contemplated herein.

Body portion 227 has a first sidewall 233 which forms one side of the adjacent recess 229. Sidewall 233 includes a projection 235 along its length which projection extends laterally into the recess 229. Each clamp members 231 includes a cooperating guide recess 237 adapted for lateral sliding movement on wall projection 235. Further, the upper region of clamp members 231 define engagement portions 239 which are dimensioned to be slidingly received between the sidewall projection 235 and an upper wall 241 of the tool support body portion 227. The above described cooperation assures proper lateral movement of the clamp members 231 within the tool body portion while simultaneously prohibiting rotational movement of the clamp members which would otherwise occur due to the rotational moments placed on the clamp members upon normal tool clamping.

Each clamp member 231 has a second or spring recess 243 therein which opens toward the first wall portion 233. Recesses 243 house compression springs, which may take the form of Belleville springs 245, as in the embodiment shown. Springs 245 are maintained in compression and function to bias the respective clamp members 231 leftwardly thereby to engage the punch tool 247 as illustrated in FIG. 12.

The force of the springs 245 secures the tool 247 during operation of the press. To enhance securement, the clamp members 231 each have a clamp portion 249 which engages the tool 247. The clamp portion 249 has a ledge portion 251 which defines a generally L-shaped space for receiving the complementary L-shaped connection portion 253 of the tool 247. This overlapping engagement between the tool and clamping members provides a safety against the inadvertent tool loss upon hydraulic or mechanical clamp deactivation.

Each of the independently movable clamping members 231 is independently biased to the clamping position by its respective spring 245. When the tool 247 is placed in the tool support structure 201, all of the clamping members 231 are independently urged by the springs 245 toward the tool. Each clamping member 231 will therefore move toward the clamping portion until that clamping member 231 clampingly engages the tool 247. Advantageously the present use of plural short clamping members 231 (each being about one inch long) ensures clamping contact at least every inch along the length of the tool, despite variations in the thicknesses of the tool and clamp members. Moreover, several tools of differing thickness may be secured at the same time with the tool support structure of this invention, and each will be tightly clamped due to the segmented clamping action of the independent clamping members 231. For release of the tool 247 from the tool support structure 201, a release system is provided which overcomes the force of the springs 245 and simultaneously moves all clamp members 231 away from clamped engagement with the tool 247.

Figure 15:
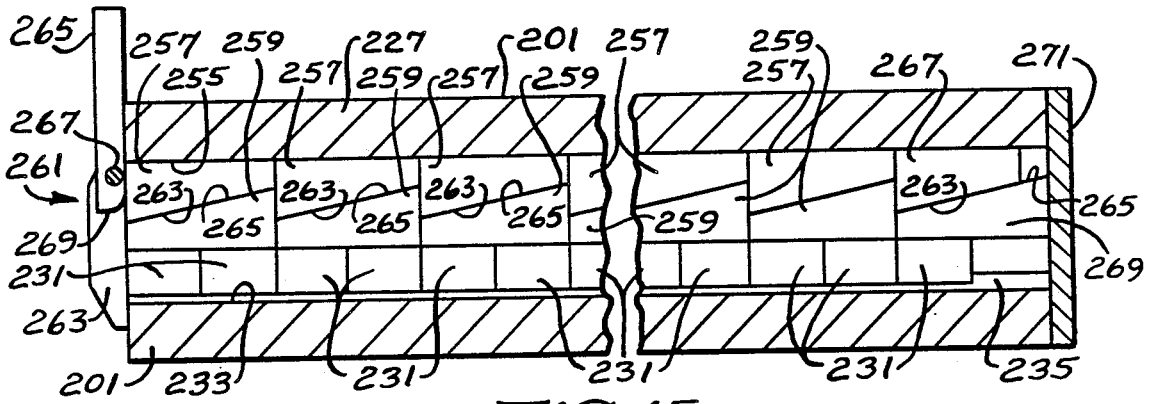
FIG. 15 is a cross-sectional view taken along line 15—15 of FIG. 9 and shows the ram clamp assembly in the clamped condition.
Figure 16:
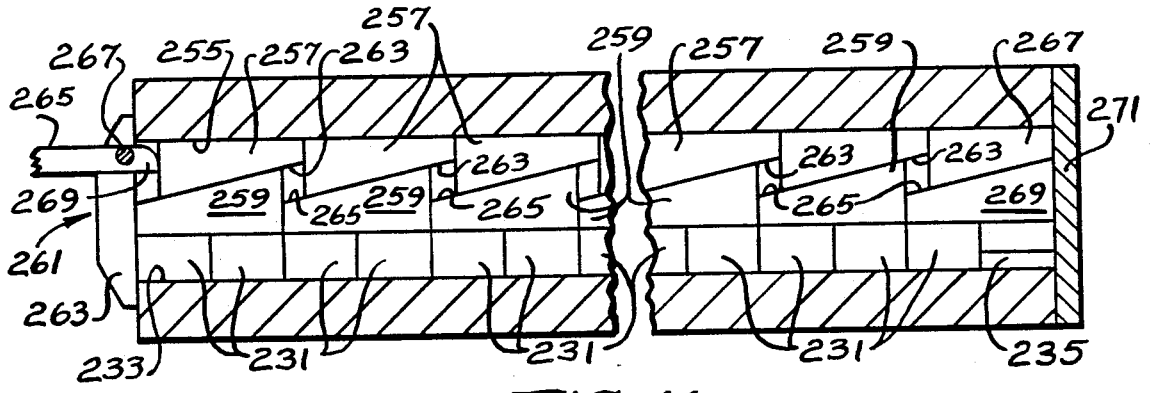
FIG. 16 is a view as in FIG. 15, but shows the clamp assembly in the release condition.

One embodiment of the present segmented clamp member release system is shown in FIGS. 14, 15 and 16. This cooperating wedge release system is supported in the recess 229 between the first sidewall 233 and a second sidewall portion 255 of the body portion 227. The release system includes a plurality of wedge-shaped longitudinally movable release members 257 positioned in longitudinal abutting relationship within the recess 229 adjacent the second sidewall 255, and a plurality of wedge-shaped laterally movable release members 259 similarly positioned in longitudinal abutting relationship within the recess adjacent the clamp members 231.

A handle structure generally indicated at 261 is provided at one end of the clamping assembly for moving the longitudinally movable release members 257, longitudinally with respect to the tool support structure 201. Handle structure 261 includes a pair of brackets 263 supported on the structure 201, and a handle member 265 which has a pivoted connection 267 connecting with the brackets 263. The handle member 265 has a protrusion or cam 269 eccentrically extending from the pivoted connection 267. As a result, rotation of the handle member 265 about pivotal connection 265 causes cam 269 to engage the outward end of the adjacent longitudinally movable release member 257 thereby urging, in turn, all of the abutting release members 257 longitudinally away from the handle structure 261 (to the right as viewed in FIG. 16).

Release members 257 and 259 each have interengagement means which co-act to cause the laterally movable release members 259 to move laterally (downwardly as viewed in FIG. 16) in response to the corresponding movement of the longitudinally movable release members 257. In the embodiment shown, the interengagement means takes the form of angled or wedge-shaped camming surfaces 263 and 265 on the respective release members, 257 and 259. The longitudinal sliding movement of surfaces 263 against respective opposed surfaces 265 force the lateral (or downward, FIG. 16) movement of release members 259.

Each of the laterally moveable release members 259 engages two clamp members 231. The lateral movement of release members 259 forces the corresponding lateral movement of the clamp members 231 thereby overcoming the force of the springs 254. The movement of the clamping members 231 proceeds to the position shown in FIGS. 11, 13 and 16 where the clamping member 231 has been moved a sufficient distance for the tool 247 to be released and removed from between engagement portion 249 and body portion 227.

The angle of the wedge-shaped surfaces 263 and 265 is preferably in the range of 14° to 15° as measured in relationship to the longitudinal axis of the structure 201. Also, these angled surfaces may be provided with friction reduction means, such as a Teflon coating or a ball bearing structure, to improve the mechanical efficiency of the release system.

The longitudinally movable release member furthest from the handle structure, indicated at 267, is foreshortened to allow clearance for the rightward (as viewed in FIG. 16) longitudinal movement of release members 257. The last of the lateral release numbers, indicated at 269, engages end wall 271 affixed to the end of body portion 227. This wall prevents longitudinal movement of the second release members 259 and ensures that the movement thereof will be only in a substantially lateral direction.

Tools 247 are secured within the ram support structure 201 by lifting the tool upwardly and positioning it as shown in FIG. 11. This is done with the clamping assembly in the released condition, as illustrated in FIG. 16. Handle 265 is thereafter rotated to retract cam 269 from the first of the longitudinally movable release members 257. Upon retraction of cam 269, the biasing force of springs 254 moves the clamp members 231 into clamping engagement with the tool while simultaneously returning the release members 257 and 259 to their original position as shown in FIG. 15.

A barrier or retention member 273 is provided below the release members 257 and 259. Member 273 serves as a guide to retain the release members in proper position during their respective longitudinal and lateral movements as well as a barrier to prevent potentially damaging contact of the release numbers 257 and 259 by the tool.

Referring to FIGS. 10 and 11, the lower tool support structure 205 is substantially a mirror image of the upper tool support structure 201, and like parts are given like reference numbers. The primary difference in the lower structure 205 is that the associated clamp members 275 are configured to clamp a die tool having a rectangularly cross-sectioned foot, as contrasted with the L-shaped connection foot 253 of the upper support structure.

FIGS. 17 through 22 disclose a further alternate embodiment of the invention, which is similar to the embodiment disclosed and described with regard to FIGS. 9 to 16, but employs a hydraulic release mechanism.

As best shown in FIG. 17, press brake ram 301 supports upper tool structure 303, which is secured thereto by fasteners 305. Tool structure 303 supports upper tool 307 which is configured to co-act with lower tool 309 to bend material placed therebetween when the ram 301 descends. Lower tool 309 is supported on lower tool structure 311 secured to bed 313.

Tool structures 303 and 311 have respective connection feet 315 and 317 which are clamped to the ram 301 and bed 313 respectively in a manner emulating the mounting of a conventional tool.

Each of the tool structures 303 and 311 has a recess 321 which supports a clamping assembly therein. The clamping assembly includes a plurality of clamping members 323, which are similar to those disclosed in FIGS. 9 to 16. Each clamping member 323 spans approximately one inch of the length of the tool structure 303 and 311, and is supported for substantially linear lateral movement on projection 325. Each clamping member 323 has a recess 327 (FIG. 20) therein which receives a biasing means, as a Belleville spring, which engages projection 325 and urges the clamping member 323 to clamp the associated tool between engagement portion 329 and opposing wall 331.

A pressurized system for releasing the clamping action is provided. A source of pressurized fluid, such as hydraulic fluid or air is provided which includes operator control means in the form of a valve which may be manually operated to selectively supply pressure to conduits 333 and 335 (FIG. 17). Each conduit 333 and 335 communicates with a plurality of inlets 337 connected with a force transmission system, such as cylinders 339. The cylinders 339 each have reaction portions including shafts 341 which are urged outwardly of the cylinders 339 when pressurized fluid is applied through conduits 333 and 335.

Figure 20:
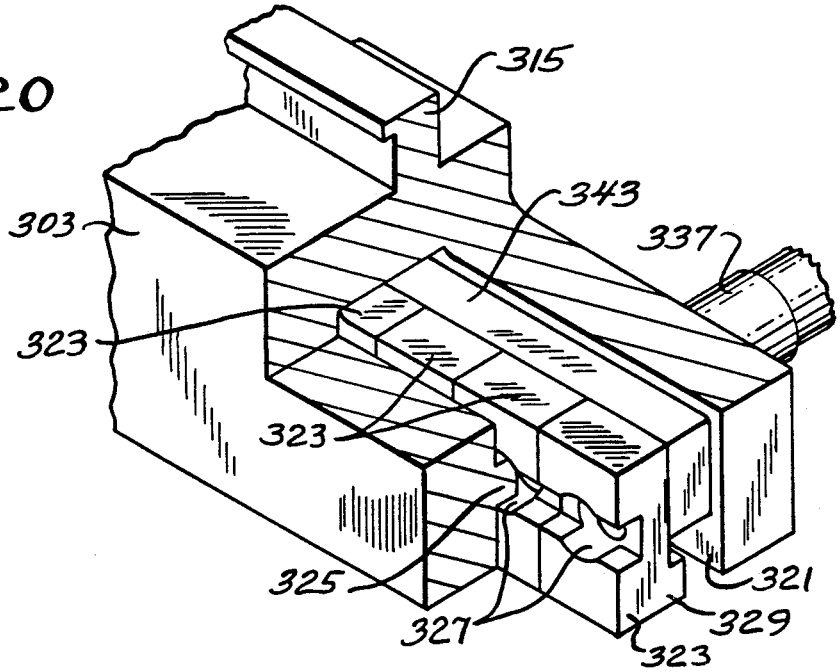
FIG. 20 is a partially cut-away perspective view of the ram clamp assembly of FIG. 17.
Figure 21:
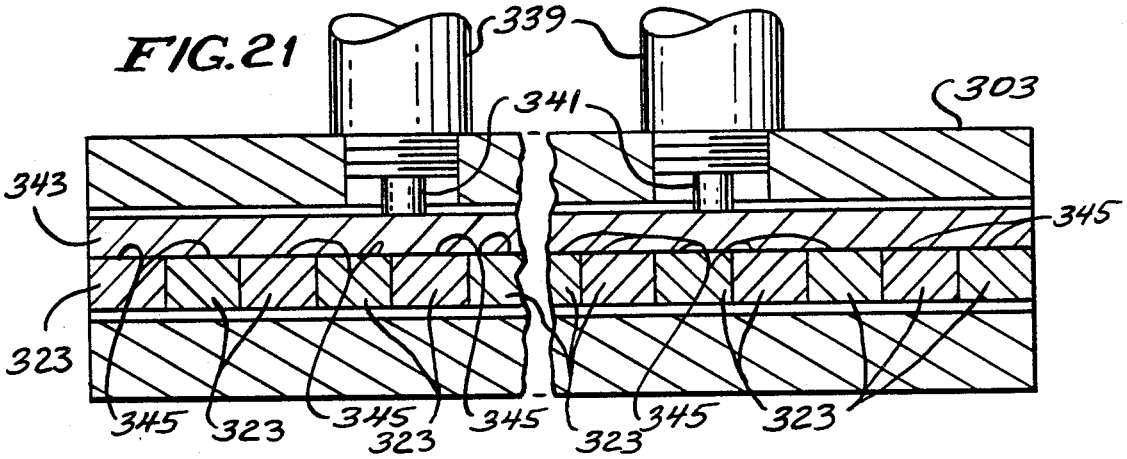
FIG. 21 is a sectional view taken along line 21—21 of FIG. 18, showing the clamping assembly clamped.
Figure 22:
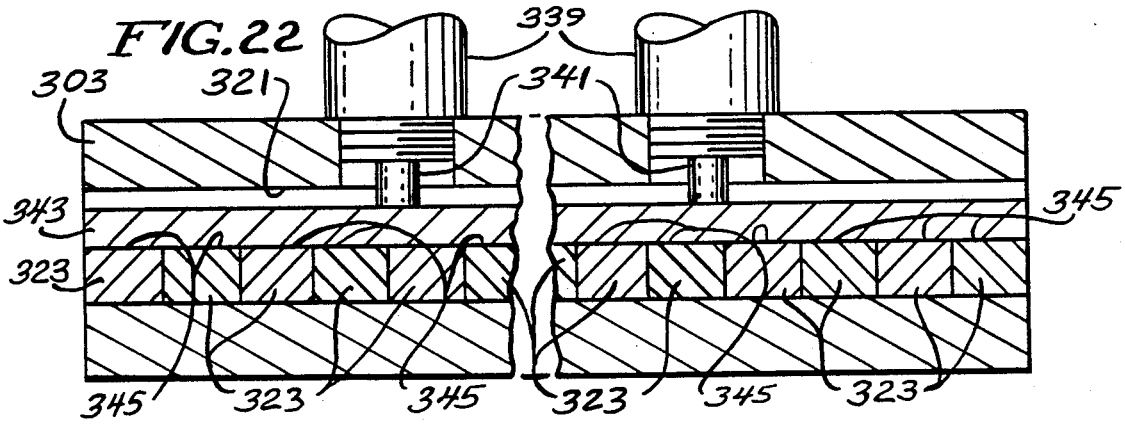
FIG. 22 is a sectional view taken along line 22—22 of FIG. 19, showing the clamping assembly in the release condition.

Referring to FIGS. 20, 21, and 22, shafts 341 contact a clamp engagement member 343 which extends longitudinally substantially the length of the tool structure 303 and 311. The clamp engagement member 343 is movable laterally with respect to the tool structure and engages a wall portion 345 of each of the clamping members 323.

FIGS. 18 and 21 show the location of clamp contact member 343 with the tool clamped, that is, with hydraulic pressure removed from cylinders 339 whereby the Belleville springs urge respective clamping members 323 into firm tool engagement. FIGS. 19 and 22, by comparison, illustrate the position of the clamp contact member 343 upon tool release. In this mode, clamp contact member 343 serves as an interface member to transfer and distribute the release forces from each of the spaced cylinders (through respective shafts 341) generally evenly to the plurality of relatively short contact members 323.

Actuation of cylinders 339, with its corresponding tool clamp release, requires the application of pressurized hydraulic fluid to either or both of conduits 333 and 335. As with earlier embodiments, should the source of pressurized fluid be interrupted, the clamping members 323 remain in firm clamping engagement with the tool.

Use of the disclosed system will eliminate the need for loosening and retightening a series of bolts or set screws every time the tool set is changed. By requiring positive pressure to open the press brake clamps the possibility of accidental clamp opening is virtually eliminated. Further, the new bed clamp assembly described above will prevent the sliding clamp member from shifting out of position when the clamp is closed.

It will be understood that changes may be made in details of construction, arrangement and operation without departing from the spirit of the invention, especially as defined in the following claims.

What is claimed is:

1. A press brake apparatus comprising:

a substantially stationary bed structure; and a ram structure supported for relative reciprocal movement toward and away from the bed structure;

the ram structure and the bed structure including first and second tool structures adapted to coact for working stock place therebetween during reciprocation of the ram structure;

one of said tool structures comprising:

a body portion having first and second wall portions generally facing each other to define a recess therebetween in the body portion, the recess being oriented to generally face the other of the tool structures;

a tool member supported in said recess for co-acting with the other of the tool structures to work stock;

clamping means supported in said recess and movable therein between a release position and a clamped position, said clamping means in the clamped position securing the tool member in the recess and in the release position permitting the tool member to be withdrawn from the recess;

biasing means engaging said clamping means and said first wall portion, said biasing means urging said clamping means to move to the clamped position;

releasing means operatively associated with the clamping means for moving said clamping means to the release position, said release means being selectively activatable by an operator to cause the clamping means to move to the release position to release the tool member for replacement thereof.

2. The invention according to claim 1 and said clamping means being supported in said recess between the wall portions.

3. The invention according to claim 1 and said release means including a pressurized fluid device having first and second ends which move apart when the pressurized fluid device is activated, one of said ends being operatively associated with the body portion of the tool structure, and the other of said ends being operatively associated with the clamping means for moving the clamping means into the release position to release the tool member when the device is activated.

4. The invention according to claim 1 and said clamping means comprising a plurality of longitudinally located clamp members, each of said clamp member being generally less than 12 inches in longitudinal length for enhancing tool gripping action of the clamping means.

5. The invention according to claim 4, and each of said clamping members being approximately one inch in longitudinal length.

6. The invention according to claim 5 and said first wall portion having a projection thereon extending generally into the recess, and each of the clamping members having a receiving recess therein receiving the projection therein for support of the clamping members.

7. A press brake apparatus comprising:

a substantially stationary bed structure; and a ram structure supported for relative reciprocal movement toward and away from the bed structure;

the ram structure and the bed structure including first and second tool structures adapted to coact for working stock placed therebetween during reciprocation of the ram guide;

one of said tool structures comprising:

a body portion extending generally longitudinally with respect to the apparatus and having a recess therein oriented to generally face the other of the tool structures;

a tool member supported is said recess for coacting with the other of the tool structures to work stock;

a plurality of longitudinally positioned clamping members supported i said recess, each of said clamping members being independently movable in said recess between a clamped position wherein each clamping member engages the tool member for securing the tool member for securing the tool member in the recess and a release position permitting the tool member to be withdrawn from the recess;

biasing means engaging said clamping members for urging each of said clamping members to move to the clamped position thereof;

release means operatively associated with the clamping members for moving said clamping members to the release position, said release means being selectively activatable by an operator to cause the clamping members to move to the release position to release the tool member for replacement thereof.

8. That 7 and each of said clamping members being generally between one-half inch and six inches in longitudinal lengths.

9. The invention according to claim 7 and said release means comprising first and second release members, said release members each including respective angled interengagement means engaging each other, said first release member engaging one of the clamping members, and said second release member engaging the body portion, said interengagement means causing said first release member to move in a generally lateral direction and to move said one of the clamping members into the release position when said second release member is moved in a generally longitudinal direction whereby the tool member is released responsive to said longitudinal movement.

10. The invention according to claim 7 and said body portion having a projection extending generally into the recess, and one of the clamping members having a receiving recess therein receiving the projection therein for support of the clamping means.

11. The invention according to claim 10 and said projection guiding the clamping member during movement thereof between the clamped and release position.

12. The invention according to claim 11 and the movement of said guided clamping member being substantially linear for efficient clamping action.

13. That 7 and said biasing means comprising a plurality of spring means, each spring means engaging a respective . clamp member and independently biasing said clamp member toward the clamped position.

14. The invention according to claim 13 and said spring means each including a Belleville spring member.

15. A press brake apparatus comprising:

a substantially stationary bed structure; and a ram structure supported for relative reciprocal movement toward and away from the bed structure;

the ram structure and the bed structure including first and second tool structures adapted to coact for working stock place therebetween during reciprocation of the ram guide;

one of said tool structures comprising:

a body portion having a recess therein oriented to generally face the other of the tool structures;

a tool member supported is said recess for coacting with the other of the tool structures to work stock;

clamping means supported in said recess and movable therein between a release position and a clamped position, said clamping means in the clamped position securing the tool member in the recess and in the release position permitting the tool member to be withdrawn from the recess;

biasing means engaging said clamping means and urging said clamping means to move to the clamped position;

release means operatively associated with for moving said clamping means to the release position the clamping means, said release means being selectively activatable by an operator to cause the clamping means to move to the release position to release the tool member for replacement thereof;

said release means comprising:

a first release member having a first side engaging said body portion;

a second release member having a first side engaging said clamping means;

said first and second release members each having respective angled interengagement means engaging each other, said interengagement means causing the second release member to move in a generally laterally direction with respect to the tool structure responsive to movement of the first release member in a generally longitudinal direction;

said second release member moving the clamping means into the release position when moved in said generally lateral direction whereby movement of the first release member in said longitudinal direction causes said tool structure to release the tool member.

16. The invention according to claim 15 and a barrier member supported between said release members and said tool member to prevent contact therebetween.

17. The invention according to claim 15 and said first and second interengagement means comprising first and second coacting cam surface portions for camming action between said release members.

18. The invention according to claim 17 and one of said cam surface portions having friction reduction means thereon for facilitating the camming action.

19. The invention according to claim 15 and said clamping means comprising first and second clamping members engaging said first side of said second release member, each of said clamping members being independently movable between clamped and release positions for enhanced clamping of the tool member.

20. The invention according to claim 15 and a handle means operatively associated with the first release member for moving said first release member longitudinally with respect to the tool structure responsive operator use of the handle means.

21. A press brake apparatus comprising:

a substantially stationary bed structure; and a ram structure supported for relative reciprocal movement toward and away from the bed structure;

the ram structure and the bed structure including first and second tool structures adapted to coact for working stock placed therebetween during reciprocation of the ram guide;

one of said tool structures comprising:

a body portion extending generally longitudinally with respect to the apparatus and having a recess therein oriented to generally face the other of the tool structures;

a tool member supported in said recess for coacting with the other of the tool structures to work stock;

a plurality of longitudinally positioned clamping members supported in said recess, each of said clamping members being independently movable in said recess between a clamped position wherein each clamping member engages the tool member for securing the tool member in the recess and a release position permitting the tool member to be withdrawn from the recess;

biasing means engaging said clamping members for urging each of said clamping members to move to the clamped position thereof;

a release member extending longitudinally with respect to the tool structure and being movable thereon to engage the clamping member and to move said clamping member into the release positions thereof;

a pressurized fluid system for moving said release member and the clamping members into the release positions thereof, said system comprising:

a pressurized fluid source including an operator activation means for permitting an operator to selectively apply pressurized fluid to the system;

force transmission means communicating with the pressurized fluid source and being connected with the release member, said force transmission means moving the release member responsive to a flow of pressurized fluid from said source whereby an operator may cause the tool structure to unclamp the tool member by using the operator activation means to apply pressurized fluid to the pressurized fluid system.

22. That 21 and the force transmission means including a cylinder structure supported on said tool structure, said cylinder structure having a reservoir therein communicating with the pressurized fluid source, and having a movable reaction portion which moves outwardly with respect to the cylinder structure when pressurized fluid is applied thereto, said movable reaction portion being connected with the release member, said reaction portion moving the release member to unclamp the tool structure when the cylinder structure is pressurized.

* * * * *